United States Patent [19]

Monfroy et al.

[11] 3,953,756

[45] Apr. 27, 1976

[54] MATRIX FOR GAS DISCHARGE DISPLAY PANELS

[75] Inventors: Henri Monfroy; Jean Philippe Reboul, both of Paris, France

[73] Assignee: Thomson-CFS, Paris, France

[22] Filed: Feb. 6, 1975

[21] Appl. No.: 547,603

[30] Foreign Application Priority Data

Feb. 12, 1974 France ..... 74.04656

[52] U.S. Cl. ..... 313/220; 313/188

[51] Int. Cl.[2] ..... H01J 61/30

[58] Field of Search ..... 313/220, 188

[56] References Cited

UNITED STATES PATENTS 3,704,052 11/1972 · Coleman ..... 313/220 UX

*Primary Examiner*—R. V. Rolinec
*Assistant Examiner*—Darwin R. Hostetter
*Attorney, Agent, or Firm*—Roland Plottel

[57] ABSTRACT

A matrix for a gas discharge display panel, consisting of a plate, made of glass for example, comprising on each of its large faces, an array of parallel grooves; said two groove array are at right-angles to one another and are sufficiently deep for the matrix to be perforated from one side to the other, at the zones of intersection of said groove arrays.

Such a matrix, arranged between two slabs, suitably separates the display cells from the electrical point of view, whilst still allowing them to communicate with one another this being an advantage where manufacture and "conditioning" of the panel are concerned.

5 Claims, 2 Drawing Figures

NEW MATRIX FOR GAS DISCHARGE DISPLAY PANELS

The present invention relates to a novel matrix for a gas discharge display panel, and to the panels comprising such a matrix.

The gas discharge display panels comprise, in accordance with a technique which is well known per se, two slabs (of glass for example) between which there is enclosed the assembly of display cells, that is to say the cells of ionisable gas, and the control electrodes.

In one embodiment of these panels, the control electrodes, constituted by two intersecting arrays of conductive strips, are directly deposited upon the mutually opposite faces of the two slabs and are covered with a layer of transparent dielectric material, a vitrified mineral enamel for example. The assembly is closed off by a sealing ring stuck between the two slabs at their peripheries and delimiting the gastight enclosure into which the ionisable gas is introduced.

At the current state of the art, there are two major classes of such panels:

The non-matrix panels in which the display cells are only delimited, when a control voltage is applied to the electrodes, by the configuration of the resultant electric field, and matrix panels which are those with which the present invention is concerned.

In the known matrix panels, an insulating matrix containing a rectangular array of holes, is introduced between the two slabs, the holes are located opposite the points of intersection between the electrodes of the two intersecting arrays. The display cells are thus physically delimited in relation to one another.

These matrices are generally manufactured from sheets of glass, using photogravure processes and present several drawbacks.

First of all, their manufacture is a delicate procedure. In other words, in forming holes through a mask, in a fairly thick plate by a technique of photogravure, the resultant holes are not absolutely cylindrical but in fact have a frustoconical shape. This is due to the lateral etching phenomenon, an effect which is well known in the context of photogravure. To prevent this effect from becoming too marked, matrices are manufactured in two stages with the help of two masks which at each side of the matrix represent the bases of the cells.

Other drawbacks arise from the fact that the cells are completely isolated from one another.

On the one hand, at the time of evacuation of the panel and subsequent filling with the ionisable gases, the gases do not readily flow into the cells located furthest away from the pip used for the pumping and filling operations, since the flow can only take place in the form of a lateral leakage between the matrix and the slabs of glass which entrap it.

On the other hand, the "conditioning" of the panels is difficult to effect. It is well known that in order for the response time of a panel to be sufficiently short, it is necessary that the display cells should contain a few free electrons in order to ionise very quickly on application between their control electrodes of the control voltage. A simple method of producing these free electrons consists in leaving certain cells of the panel, those as its periphery, for example, illuminated. The light thus produced illuminates the other cells and produces conditioning photo-electrons there. However, for this kind of conditioning phenomenon to be effective, it is necessary, and this goes without saying, that the matrix should be transparent to the radiation producing this kind of photo emission. Experience shows that with the glasses normally used, conditioning is only effective over fairly short distances (some few cells) between the conditioning cell and the cell which is to be conditioned.

The matrices in accordance with the invention do not contain any cylindrical hole and do not involve, therefore, such delicate operations in their manufacture as those of the prior art.

Moreover, the gas cells which they delimite are not completely isolated from one another so that the panels in which they are installed are on the one hand easier to evacuate and to fill with ionisable gases, and on the other easier to "condition".

According to the invention there is provided a matrix for a gas discharge display panel comprising an insulating plate each of whose two large faces contains an array of mutually parallel grooves, the grooves of one of said two groove arrays being right-angles to those of the other of said two groove arrays and the depth of the grooves in each of the said two groove arrays being such that the matrix is perforated from one of its two large faces to the other at the zones where the grooves of the two arrays intersect.

To build a display panel, such a matrix is inserted between two slabs upon which there have been deposited two intersecting arrays of control electrodes, covered by a layer of a transparent dielectric material, said matrix being manufactured and arranged in such a fashion that each array of grooves is perpendicular to the electrode array on the slab opposite it, and that the zones of intersection between the two said arrays of grooves are centred on the zones of intersection between the two said arrays of electrodes.

Other features of the invention will become apparent from the ensuing description given merely by way of example with reference to the accompanying drawings in which.

Figure 1:
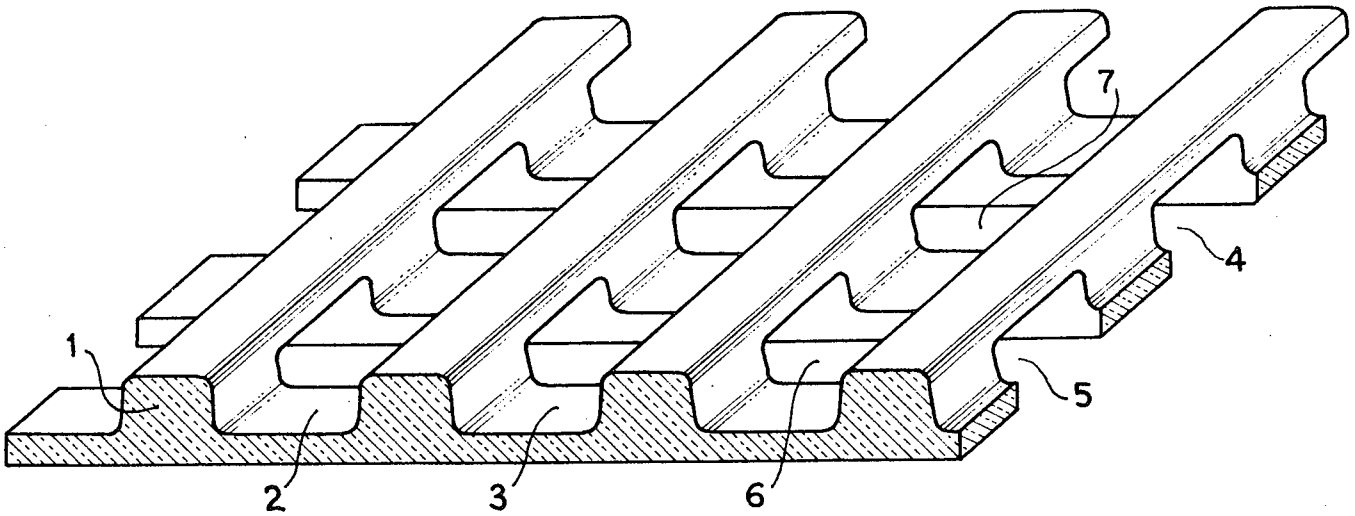
FIG. 1 is a perspective view of a matrix section in accordance with the invention.

A matrix for a display panel comprises, as shown in FIG. 1, a plate 1 of an insulating material, glass for example, each of whose two large faces contains an array of grooves such as those 2, 3, 4 and 5.

The grooves 2 and 3 for example, of the array in one of the two faces, are mutually parallel and are at right-angles to the grooves 4 and 5, in the array located in the other face.

The depth of the grooves in the two arrays is sufficient to ensure that the matrix is completely perforated, at the zones of intersection between the grooves in the arrays, and exhibits recesses 6 and 7 for example, at all these zones which, when a matrix of this kind is installed in a display panel, form the display cells.

Figure 2:
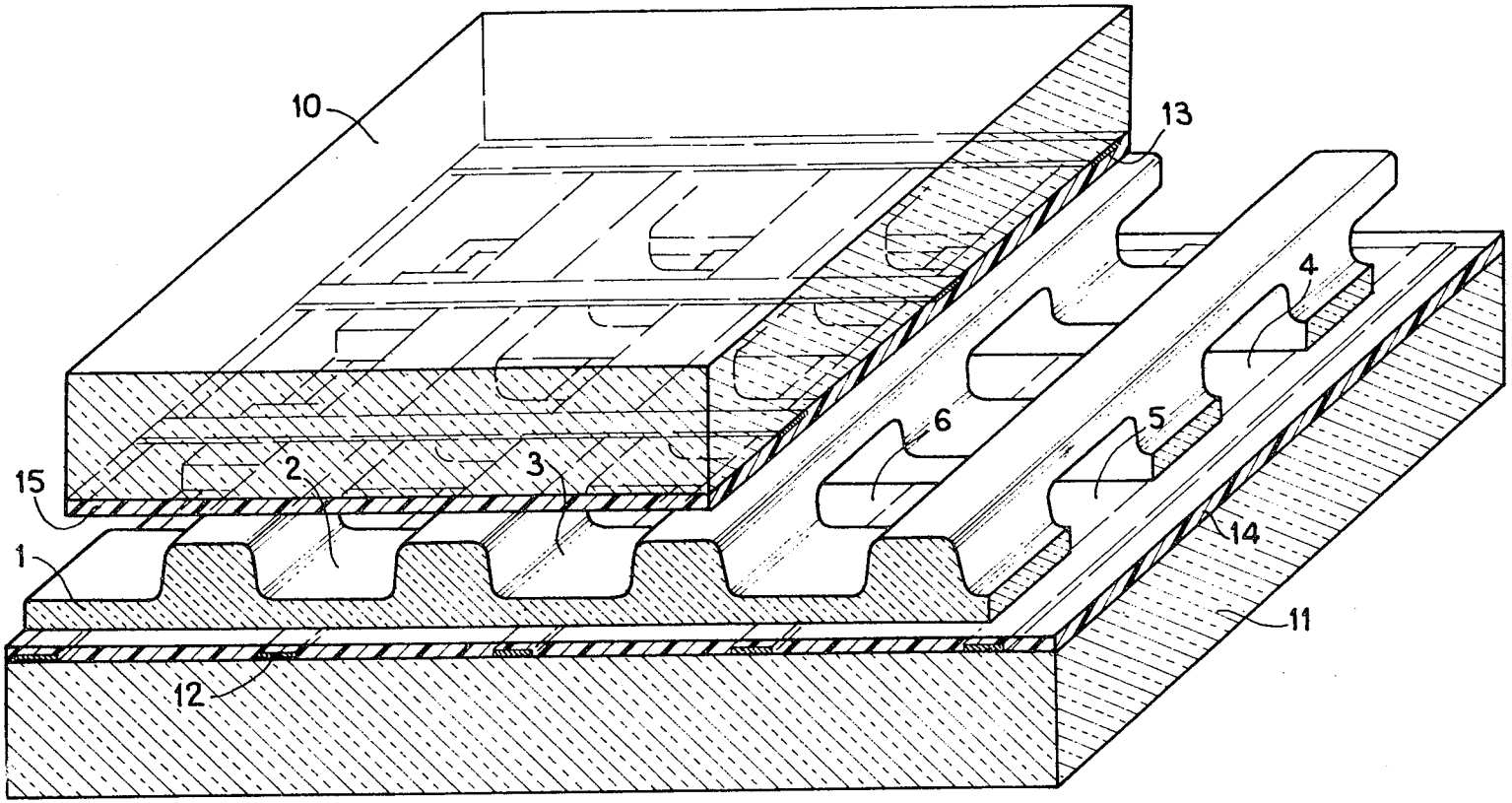
FIG. 2 is a perspective view of a part of a display panel comprising a matrix such as that shown in FIG. 1.

FIG. 2 schematically illustrates part of a display panel equipped with this kind of matrix. These conventional parts of a panel, such as the peripheral sealing ring, the pip for attachment of the vacuum pump and for filling, etcetera, have not been illustrated.

The matrix 1 shown in FIG. 1 is inserted between the two thick slabs 10 and 11, one at least of which is transparent and which are generally made of glass. Deposited upon these two slabs 10 and 11, are two intersecting arrays of electrodes such as those 12 and 13. These two electrode arrays are themselves covered with a dielectric layer 14, 15 formed, for example, by a layer of vitrified enamel.

In the example shown here and in the manner which is quite generally adopted, the display cells are regularly distributed at the surface of the panel and the pitch of the electrode arrays is constant, being in fact the same in both arrays. The pitch of the arrays of grooves in the matrix is likewise constant and again identical to that of the electrode arrays.

The matrix 1, assembled between the two slabs 10 and 11, is arranged in such a fashion that the grooves, 4 and 5 for example, in that face which is in contact with one slab, 11 in this case, are perpendicular to the electrodes 12 of the electrode array on said slab. It is moreover arranged in such a fashion that the openings such as at 6, which extend through it from one side to the other, are centred on the zones of intersection between the electrodes of the two said arrays.

The openings thus defined by the zones of intersection between the two electrodes, delimit the display cells of the panel..

It is clear that this kind of matrix, in relation to the prior art matrices, has the aforesaid advantage of making it possible to establish a good gas circulation along the grooves, and also the advantage of facilitating the transmission of light radiation and of a diffusion of charged particles for purposes of "conditioning".

It should be pointed out, furthermore, that this kind of matrix, although not completely isolating the display cells from one another, which was one of the results it was sought to achieve, isolates them sufficiently from the point of view of the electric fields, to ensure that the illumination of a cell for display purposes, does not create any risk of producing unwanted illumination of a neighbouring cell. In other words, the electric field responsible for the illumination of the cell, cannot overlap along the control electrodes of this cell since, thanks to the rectangular arrangement of an electrode array and the array of grooves corresponding to it, those parts of one and the same control electrode which are involved in controlling two neighbouring cells, are separated by the matrix ridges located between the grooves.

Thus, panels equipped with the matrix in accordance with the invention have the advantages of matrix panels generally, that is to say good containment of the discharges, whilst avoiding certain of their drawbacks.

A method of manufacturing a matrix of this kind has been described by way of example.

The basic plate 1 is a glass sheet 220 $\mu$m thick. To produce the grooves, each face of the sheet is subjected to a chemical etching operation using the conventional photolithographic process.

To do this, the two faces of the glass are protected by a photosensitive resin. This resin is exposed through a mask reproducing the array which is to be engraved, subsequently peeled off and thus leaves on the glass a residue protecting those areas which are to remain unetched. At this stage, the glass sheet is etched in a bath of ammonium bifluoride in a saturated aqueous solution, from around 100 minutes, until the depth of the grooves in the two arrays is such that there is an opeing at the zones of intersection between the grooves of the two arrays. Finally, the remaining photosensitive resin is dissolved.

At this stage, the process of insertion of the matrix into the panel, of its covering of the supplementary layers, of its sticking in position, etcetera, etcetera, is carried out in the manner employed in conventional matrices.

It should be observed in particular that the matrix can be covered, at those of its parts with which it will come into contact with the slabs 10 and 11, with a mixture of a powdered refractory material and a binder, in accordance with U.S. Pat. No. 3,798,482 filed by the present Applicants on Mar. 31, 1972.

It should be observed, furthermore, that a matrix of this kind can be manufactured from sheets of insulating materials other than glass; it can be manufactured, for example, from an organic polymer such as one of the polyimides.

It can be produced by photographic etching techniques or by mechanical methods.

Whatever the case, its manufacture is simpler than that of the prior art matrices containing cylindrical holes. It should be noted, furthermore, that if the electrodes are deposited upon the slabs through masks, same masks may possibly be used to manufacture the electrodes and the grooves as well, enabling a greater degree of precision to be achieved and further facilitating the manufacture of the panel.

Of course, the invention is not limited to the embodiment described and shown which was given solely by way of example.

What is claimed is:

1. A matrix for a gas discharge display panel, comprising an insulating plate each of whose two large faces contains an array of mutually parallel grooves, the grooves of one of said two groove arrays being right-angles to those of the other of said two groove arrays and the depth of the grooves in each of the said two groove arrays being such that the matrix is perforated from one of its two large faces to the other at the zones where the grooves of the two arrays intersect.

2. A matrix as claimed in claim 1, wherein the depth of the grooves in each of said two groove arrays is at least equal to half the thickness of said plate.

3. A matrix as claimed in claim 1, wherein the grooves in each one of said two groove arrays are equidistant and said two groove arrays have the same pitch.

4. A gas discharge display panel comprising two slabs carrying two crossing arrays of control electrodes covered with a transparent dielectric layer and a matrix according to claim 1 inserted between said two slabs in a tight arrangement, said matrix being so designed and so disposed between said two slabs, that each one of its two groove arrays is perpendicular to the electrode array on the slab facing it, and that said two groove arrays intersect at zones which are centred on the crossing zones of said two electrode arrays.

5. A display panel as claimed in claim 4, wherein those parts of the matrix which are facing said dielectric layers are covered with an insulating layer constituted by a mixture of a powdered refractory material and a binder.

* * * * *